US007493932B2

(12) United States Patent
Cheng

(10) Patent No.: US 7,493,932 B2
(45) Date of Patent: Feb. 24, 2009

(54) BLIND FIXING HOLDER

(75) Inventor: Ju-Sheng Cheng, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 190 days.

(21) Appl. No.: 11/346,338

(22) Filed: Feb. 3, 2006

(65) Prior Publication Data

US 2007/0181265 A1 Aug. 9, 2007

(51) Int. Cl.
*E06B 9/32* (2006.01)

(52) U.S. Cl. ..... 160/173 R; 160/178.1 R

(58) Field of Classification Search ..... 160/178.1 R, 160/178.1 V, 177 R, 177 V, 173 R, 173 V, 160/176.1 R, 168.1 R, 172 R, 170, 171
See application file for complete search history.

(56) References Cited

U.S. PATENT DOCUMENTS 2,663,368 A * 12/1953 Walker ..... 160/177 R
4,333,510 A * 6/1982 Fox ..... 160/177 R
4,643,238 A * 2/1987 Tachikawa et al. .... 160/168.1 R
5,139,072 A * 8/1992 Marocco ..... 160/176.1 R
5,538,066 A * 7/1996 Liu ..... 160/173 R
6,095,228 A * 8/2000 Liu ..... 160/173 R
6,189,596 B1 * 2/2001 Chen ..... 160/176.1 R
6,588,481 B1 * 7/2003 Hsu ..... 160/173 R
2005/0145345 A1 * 7/2005 Chen ..... 160/173 R
2005/0252621 A1 * 11/2005 Hsu ..... 160/173 R

* cited by examiner

*Primary Examiner*—David Purol
(74) *Attorney, Agent, or Firm*—Ming Chow; Sinorica, LLC

(57) ABSTRACT

A blind fixing holder includes a first convex wall and a second convex wall facing each other for assembling a roller thereon. The first and the second convex wall are respectively and symmetrically bored with a vertical slide groove and a horizontal slide groove communicating with each other. The vertical slide groove has its upper end formed with an opening and its lower end formed with a contracted neck. Thus, the opposite ends of the roller can be fitted in the horizontal slide grooves and shifted therein through the openings and the contracted necks of the two opposite vertical slide grooves. The roller can be shifted leftward or rightward in the horizontal slide groove for the pull cord at either side of the blind to be wound and supported thereon.

5 Claims, 11 Drawing Sheets

BLIND FIXING HOLDER

BACKGROUND OF THE INVENTION

1. Field of the Invention

This invention relates to a blind fixing holder, particularly to one able to be assembled and operated easily and quickly.

2. Description of the Prior Art

A conventional blind fixing holder 10 to be assembled on an upper rail, as shown in FIGS. 1 and 2, includes a bottom plate 11 having its center bored with a cord hole 111 and its opposite sides respectively extending upward to form a pivotal plate 12 for pivotally positioning a fixing core thereon. Between the two pivotal plates 12 are formed a first wall plate 13 and a second wall plate 14 facing each other and having their opposite walls respectively and symmetrically bored with a left and a right slide groove 15, and the cord hole 111 is positioned between the left and the right slide grooves 15. Thus, when a user prefers assembling the pull cord 20 of the blind at the left side, the roller 16 can be fitted and positioned in the two opposite left slide grooves 15 of fixing holder 10, and the pull cord 20 is wound around the roller 16 to be guided and supported thereon. Then, the pull cord 20 is orderly inserted through the cord hole 111 of the fixing holder 10, the upper rail and each slat of the blind, and finally fixed with the lower rail of the blind. On the contrary, when the pull cord 20 has to be installed at the right side of the blind, the roller 16 has to be removed out of the left slide grooves 15 and then fitted in the right slide grooves 15 for the right-side pull cord 20 to be wound, supported and guided thereon.

However, although the conventional blind fixing holder 10 can be assembled either with the left or the right pull cord 20, yet, when the pull cord 20 needs to be changed in position, the roller 16 on the fixing holder 10 has to be removed out of the slide grooves 15 at one side and then installed in the slide grooves 15 at the other side, inconvenient in assembling and operating. In addition, in the course of disassembling, the roller 16 is likely to fall down or be lost.

SUMMARY OF THE INVENTION

The objective of the invention is to offer a blind fixing holder includes a first convex wall and a second convex wall facing each other for assembling a roller thereon. The first and the second convex wall are respectively and symmetrically bored with a vertical slide groove and a horizontal slide groove communicating with each other. The vertical slide groove has its upper end formed with an opening and its lower end formed with a contracted neck. The opposite ends of the roller can be respectively fitted in the opposite horizontal slide grooves and shifted therein through the openings of the two opposite vertical slide grooves. Thus, when the fixing holder is assembled on the upper rail of the blind, the pull cord at either side of the blind can be wound and supported on the roller to be guided and inserted through the cord hole after the roller is adjusted and shifted to a proper side of the horizontal slide groove, easy and quick in assembling and operating.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
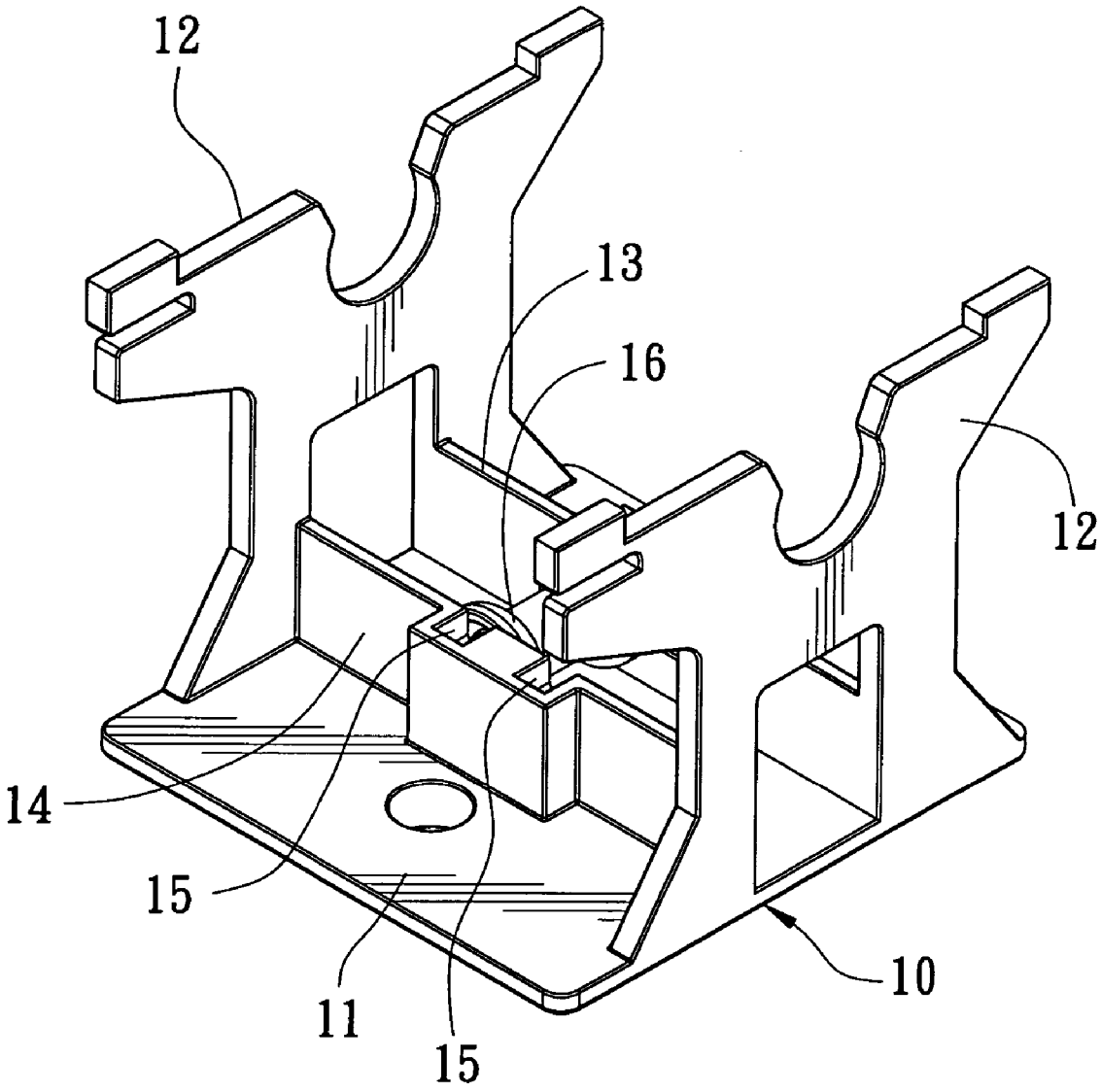
FIG. 1 PRIOR ART
FIG. 1 is a perspective view of a conventional blind fixing holder.
Figure 2:
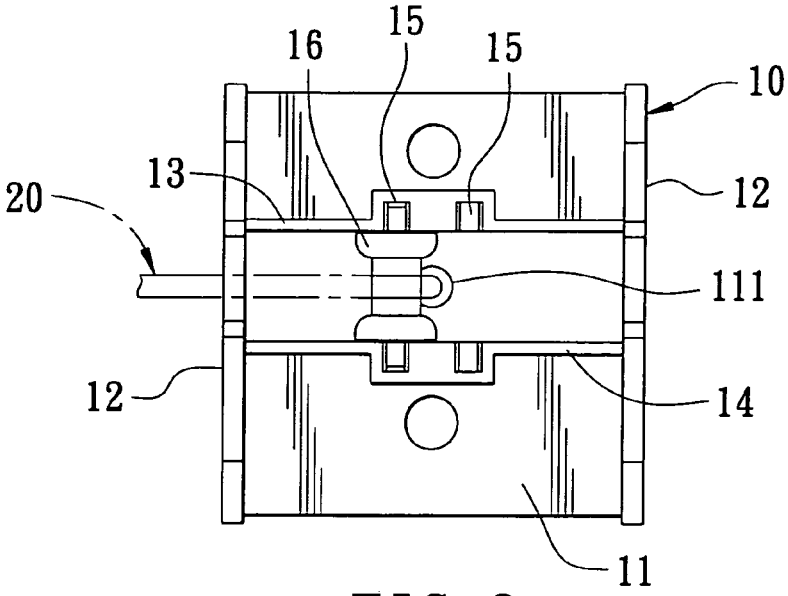
FIG. 2 PRIOR ART
FIG. 2 is an upper view of the conventional blind fixing holder.
Figure 3:
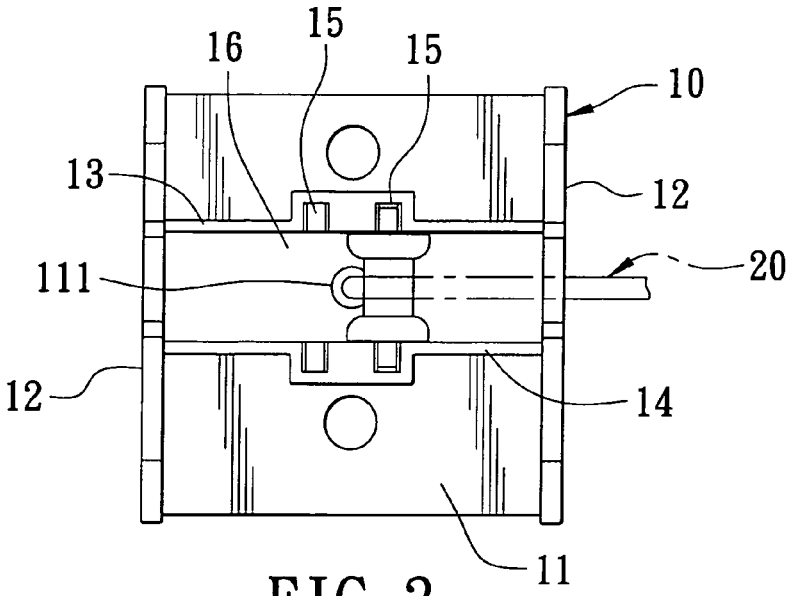
FIG. 3 PRIOR ART
FIG. 3 is another upper view of the conventional blind fixing holder.
Figure 4:
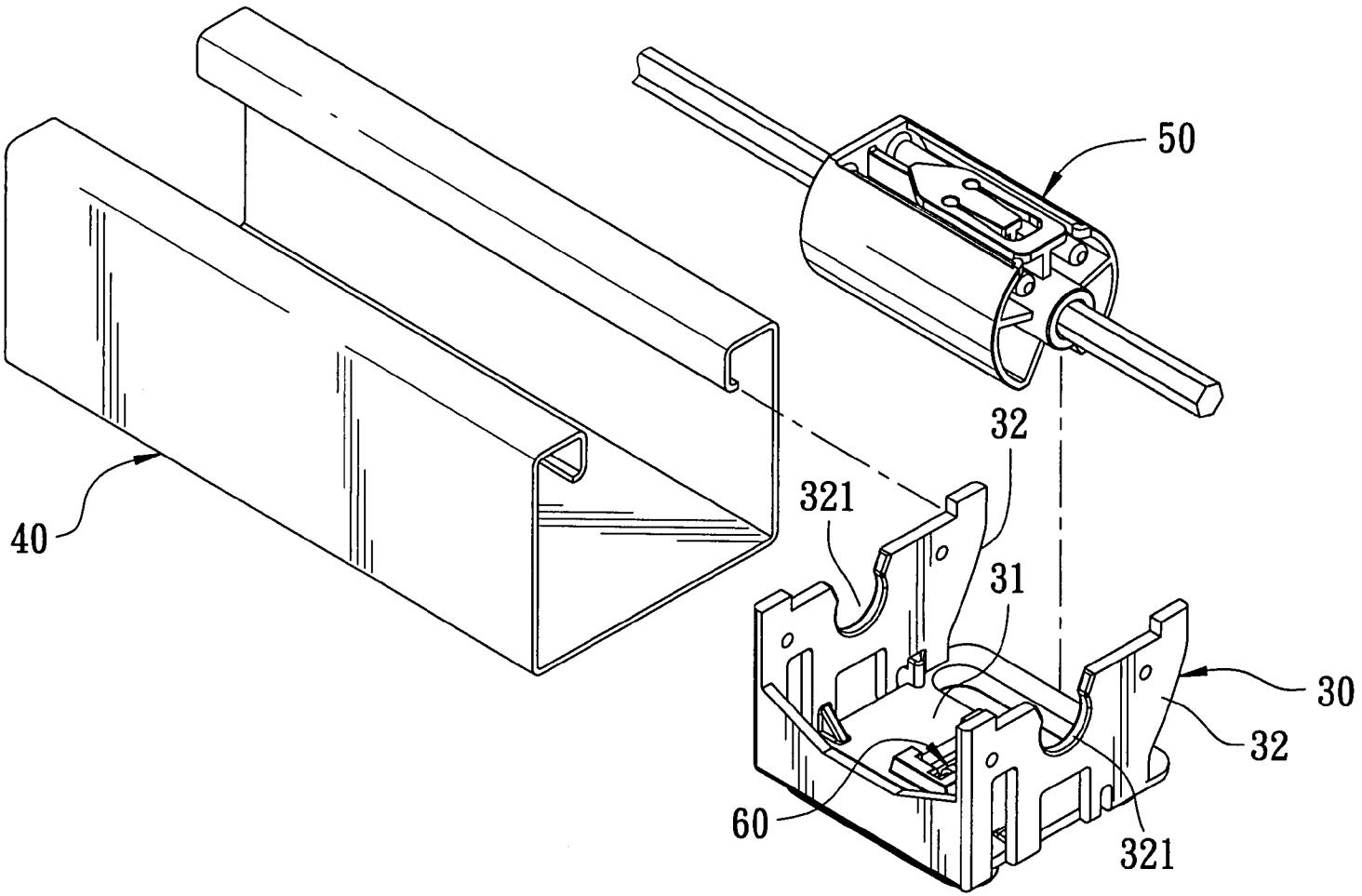
FIG. 4 is perspective views of a fixing holder, a fixing core and an upper rail of a blind in the present invention.
Figure 5:
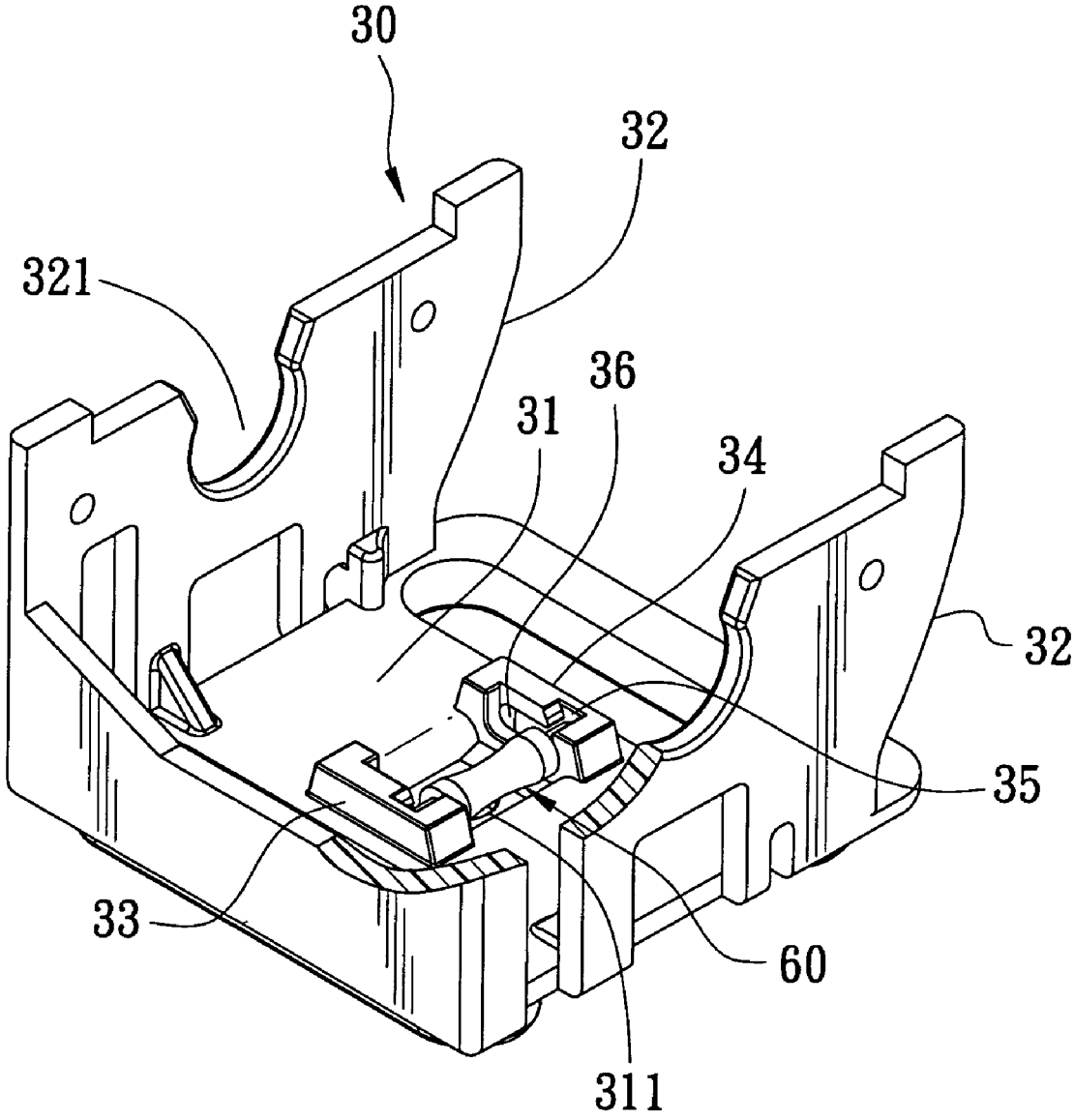
FIG. 5 is a partial perspective and cross-sectional view of the fixing holder in the present invention.
Figure 6:
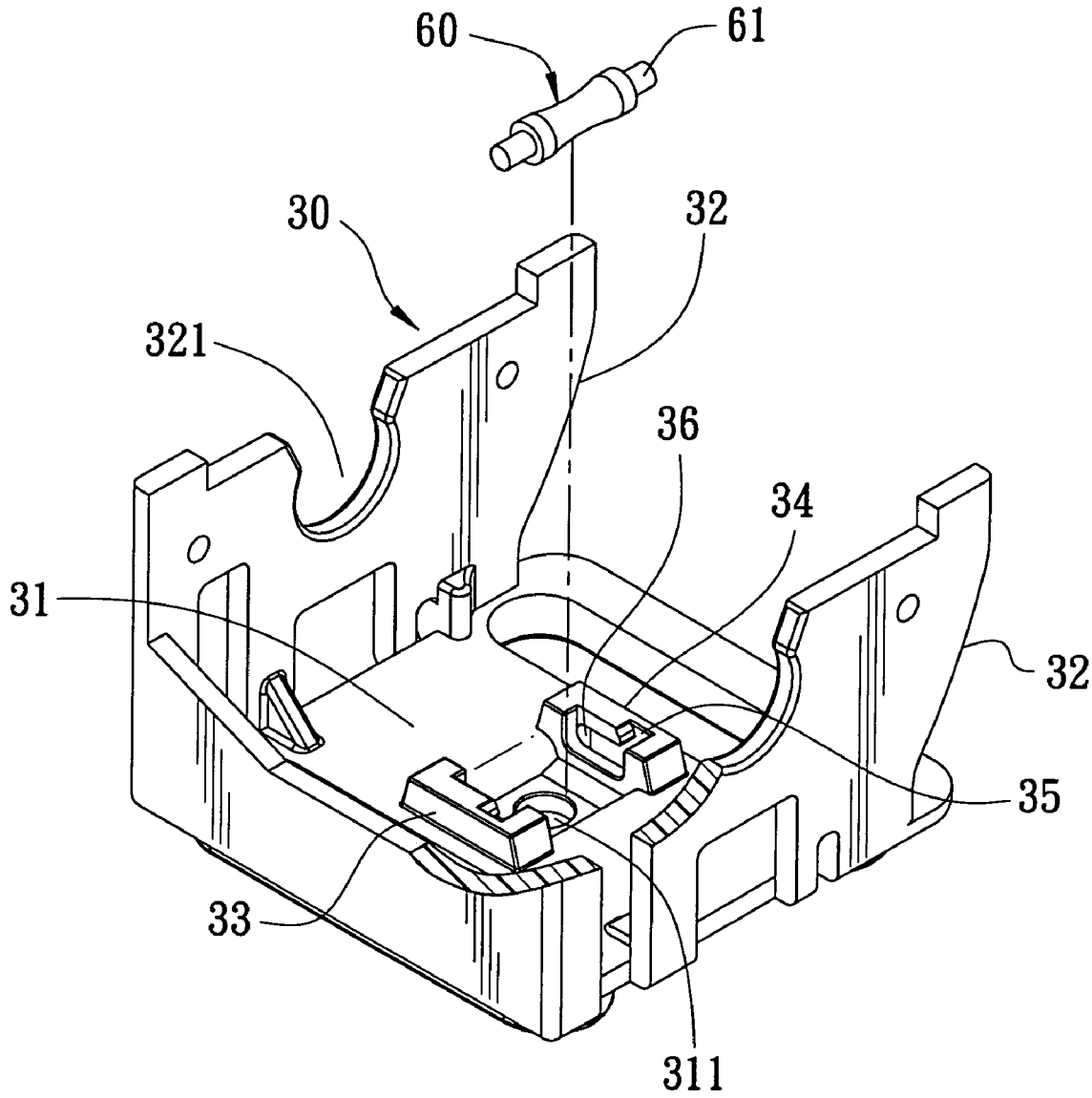
FIG. 6 is an exploded perspective view of the fixing holder in the present invention.

A preferred embodiment of a blind fixing holder 30 to be assembled at a proper location on the upper rail of a blind in the present invention; as shown in FIGS. 4, 5 and 6, includes a bottom plate 31 having its center bored with a cord hole 311 and its opposite sides respectively extending upward to form a pivotal plate 32 having its upper edge cut with a notch 321 for pivotally positioning the end of a fixing core 50. A first convex wall 33 and a second convex wall 34 facing each other are fixed on the bottom plate 31 between the two pivotal plates 32 for positioning the opposite shafts 61 of a roller 60 that can be adjusted and shifted to the left side or the right side of the cord hole 311.

Figure 7:
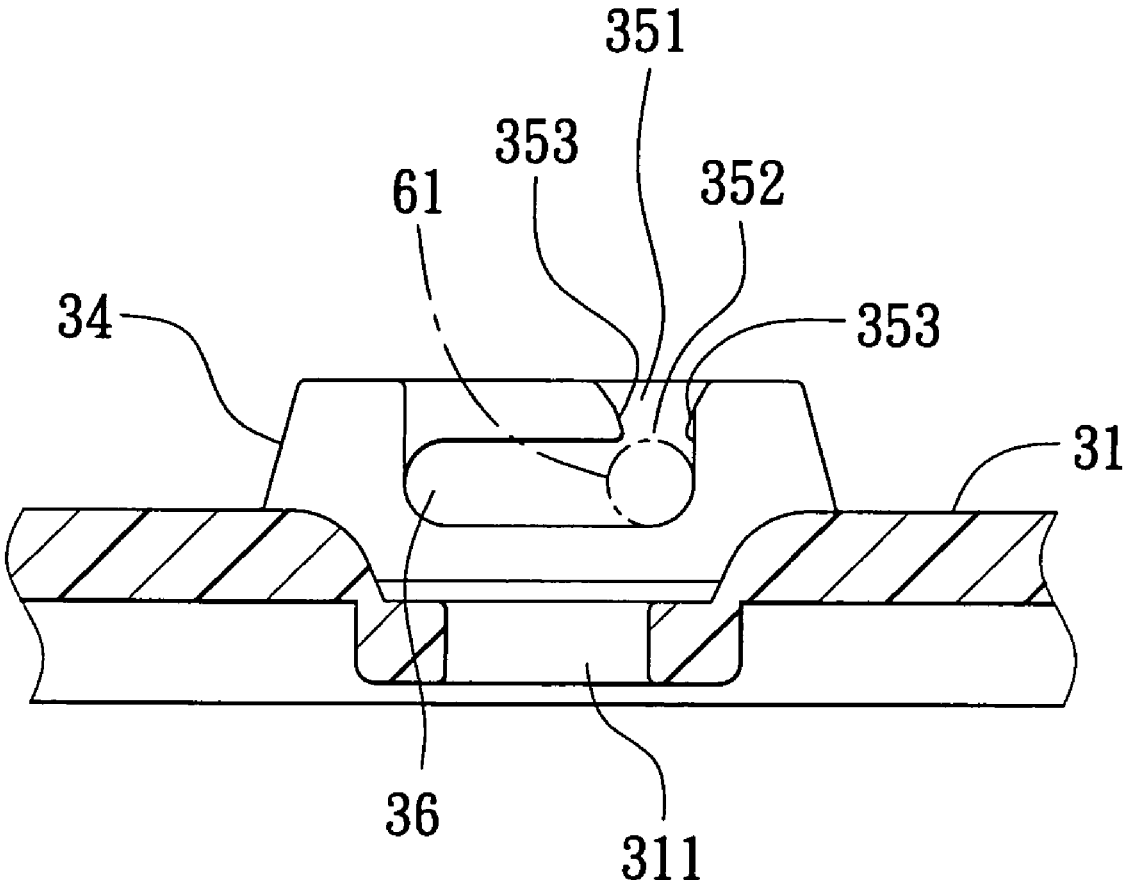
FIG. 7 is a partial side cross-sectional view of the fixing holder in the present invention.

The first and the second convex wall 34 are respectively and symmetrically bored with a vertical slide groove 35 and a horizontal slide groove 36, which are both L-shaped and communicate with each other. The vertical slide groove 35 has its upper end formed with an opening 351 and its lower end formed with a contracted neck 352 having its opposite walls respectively formed with a guiding slope 353 slanting downward gradually, as shown in FIG. 7. Thus, the opposite shafts 61 of the roller 60 can be respectively fitted in the opposite vertical slide grooves 35 through the upper openings 351 at either side and guided by the guiding slopes 353 to pass through the contracted necks 352 and slide into the horizontal slide grooves 36 to be shifted therein. The contracted necks 352 at the lower ends of the vertical slide grooves 35 can prevent the roller 60 from slipping out of the vertical slide grooves 35.

Figure 8:
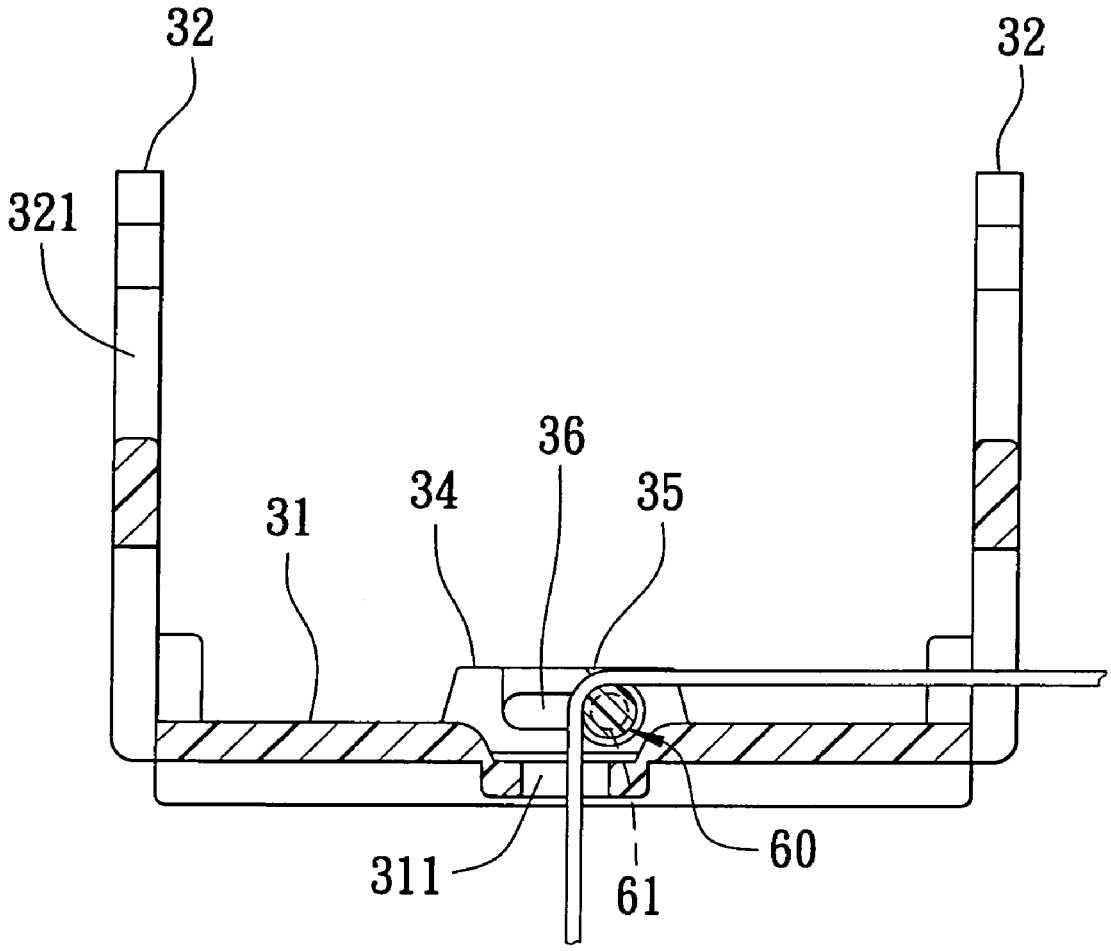
FIG. 8 is a side cross-sectional view of fixing holder having a pull cord assembled at the right side in the present invention.
Figure 9:
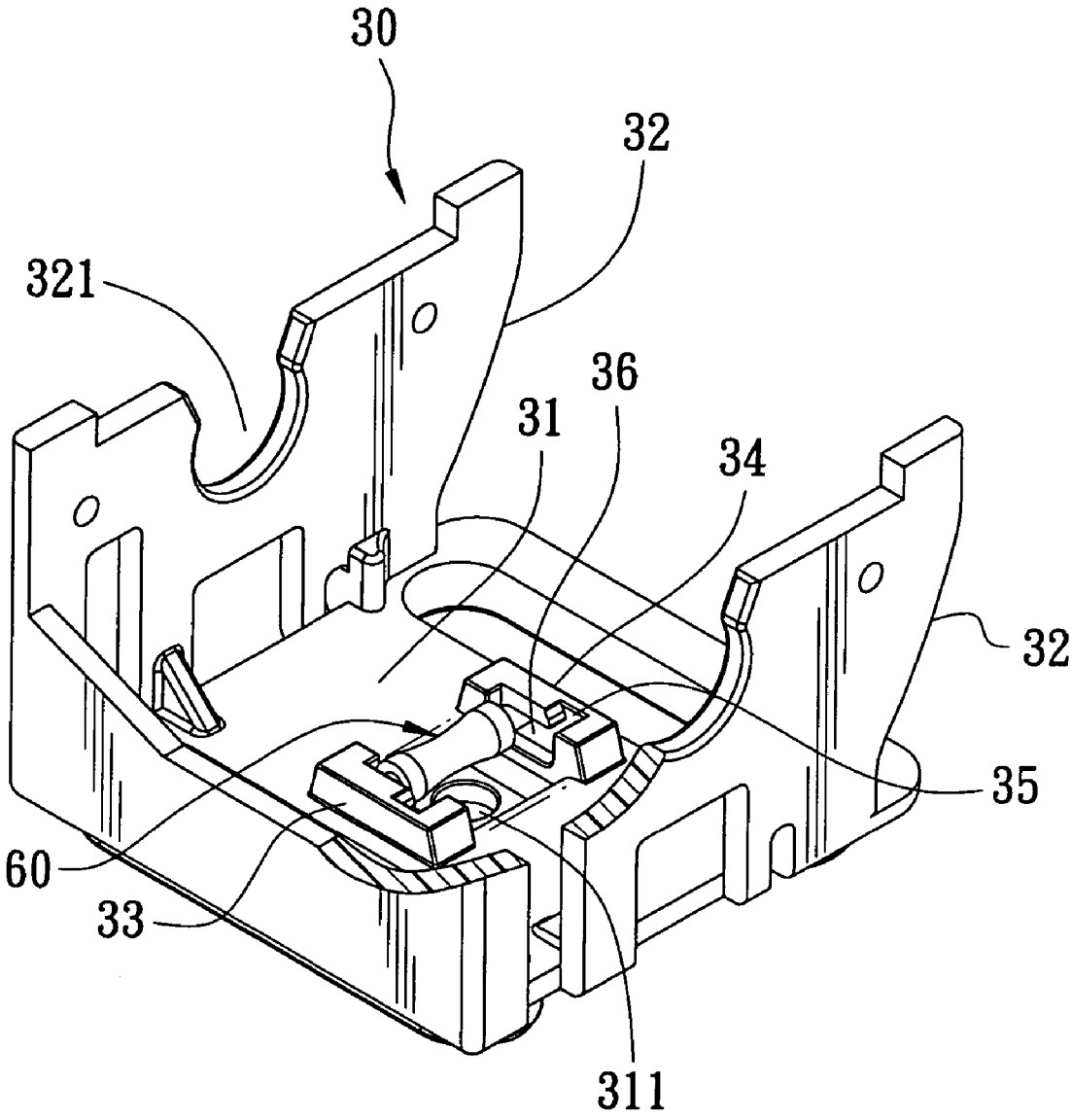
FIG. 9 is another partial perspective and cross-sectional view of the fixing holder in the present invention.
Figure 10:
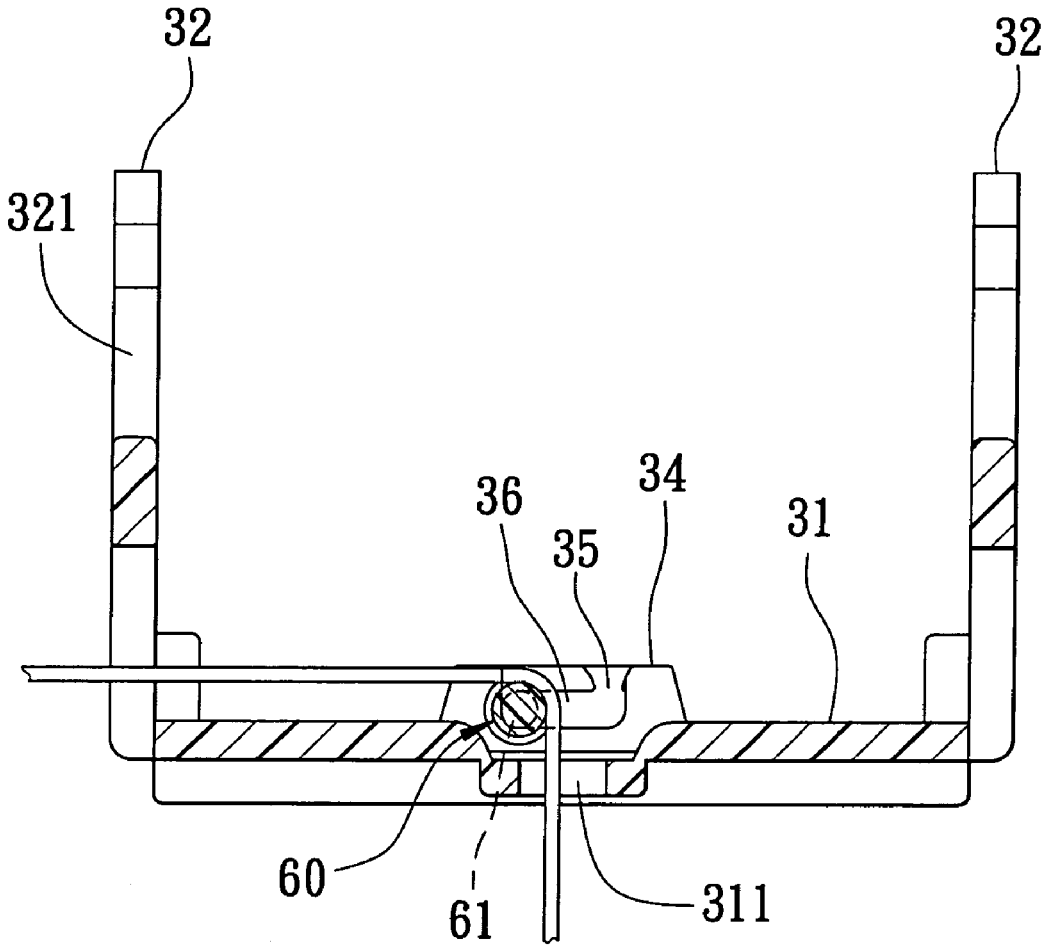
FIG. 10 is a side cross-sectional view of the fixing holder having the pull cord assembled at the left side in the present invention.

Referring to FIGS. 5 and 8, the blind fixing holder 30 of this invention can be assembled with the pull cord 70 either at the left side or the right side of the blind. When the pull cord 70 is to be installed at the right side of the blind, the roller 60 of the fixing holder 30 is shifted rightward to be positioned at the right side of the horizontal slide groove 36, and the pull cord 70 at the right side of the blind is inserted through the right-side pivotal plate 32 of the fixing holder 30, properly wound around the roller 60 to be guided and supported thereon. Then, the pull cord 70 is orderly inserted through the cord hole 311, the upper rail 40 and each slat of the blind (not shown) and finally fixed with the lower rail of the blind (not shown). On the contrary, referring to FIGS. 9 and 10, when the pull cord 70 is to be assembled at the left side of the blind, the roller 60 of the fixing holder 30 is shifted leftward to be positioned at the left side of the horizontal slide groove 36, and the pull cord 70 at the left side of the blind is inserted through the left pivotal plate 32 of the fixing holder 30, properly wound around the roller 60 to be guided and supported thereon. Then, the pull cord 70 is orderly inserted through the cord hole 311, the upper rail 40 and each slat of the blind and finally fixed with the lower rail.

Figure 11:
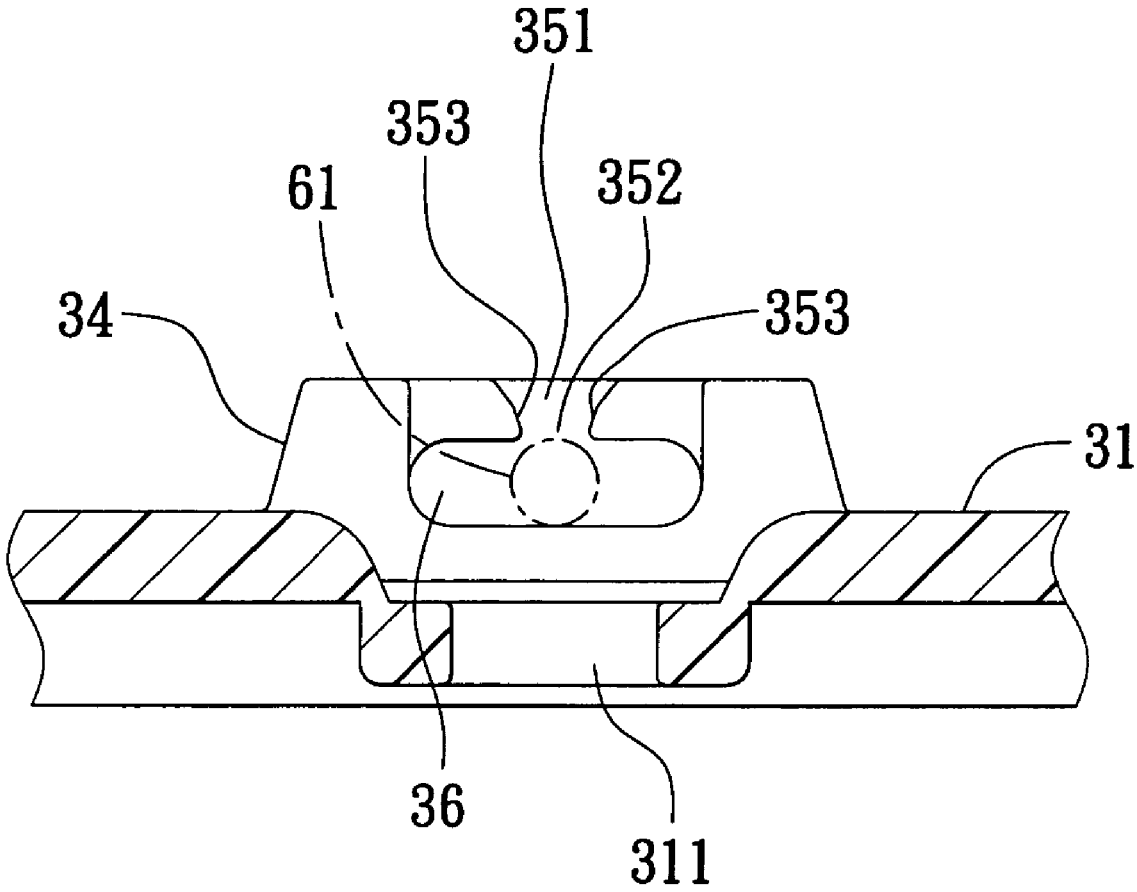
FIG. 11 is side cross-sectional view of a vertical slide groove and a horizontal slide groove communicating with each other in another condition in the present invention.
Figure 12:
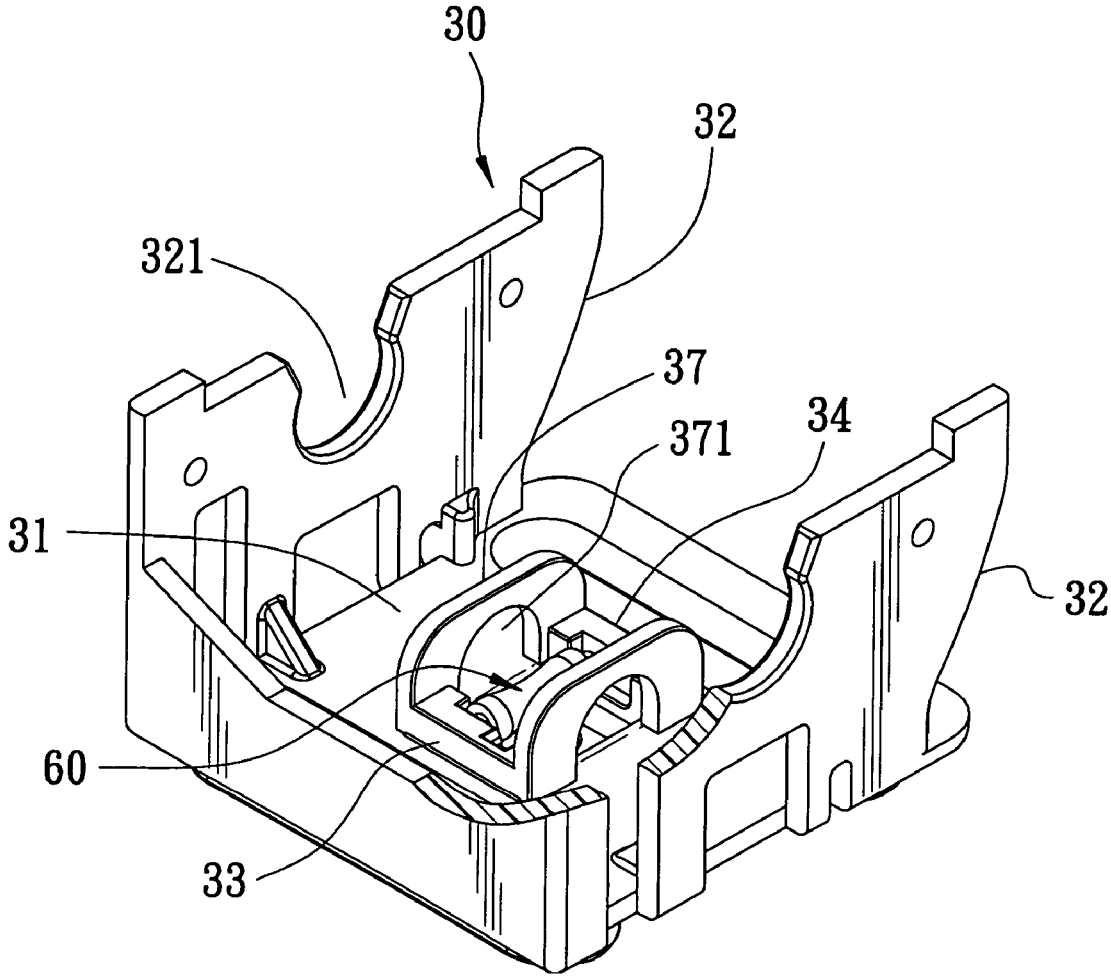
FIG. 12 is a perspective view of the fixing holder having limiting rib plates respectively provided at the opposite sides of its first and second convex wall in the present invention.

Further, the vertical slide groove 35 of the first convex wall 33 and the second convex wall 34 can also be positioned at the inter mediate portion or any other location of the horizontal slide groove 36, letting the vertical slide groove 35 and the horizontal slide groove 36 communicate with each other in a T-shaped condition. Thus, after the roller 60 is fitted in the horizontal slide grooves 36 through the vertical slide grooves 35, it can be shifted in the horizontal slide groove 36, as shown in FIG. 11. Furthermore, one side or both sides of the first and the second convex wall 33, 34 could be formed integral with a limiting rib plate 37 with an insert hole 371 for the pull cord 70 to be inserted therethrough so as to prevent the pull cord 70 from slipping off.

To sum up, the roller 60 on the fixing holder 30 of this invention can be shifted leftward or rightward in the horizontal slide groove 36; therefore, no matter which side the pull cord 70 is expected to be assembled, it is only necessary to shift the roller 60 to the left or the right side of the horizontal slide groove 36, but needless to disassemble the roller 60 from the fixing holder 30, easy and quick in assembling and operating.

While the preferred embodiment of the invention has been described above, it will be recognized and understood that various modifications may be made therein and the appended claims are intended to cover all such modifications that may fall within the spirit and scope of the invention.

I claim:

1. A blind fixing holder to be assembled on an upper rail of a blind comprising a fixing holder provided with a bottom, said bottom having a pivotal plate extending upward from two ends respectively, each said pivotal plate provided with a notch in a top end so that a rotary shaft may be positioned therein, said rotary shaft passing through a fixing core, at least two convex walls extending up in parallel from said bottom, a post extending from two ends of a roller respectively, said two posts fitted between a facing surface of said two convex walls, a bottom plate provided with a cord hole, a pull cord passing through the cord hole and the roller: and characterized by each said convex wall provided with a vertical slide groove in a side facing each other, one end of said vertical slide groove extending from an opening in a top of said convex wall towards said bottom of said fixing holder, a horizontal slide groove provided in said convex wall and extending longitudinally from a point at a preset distance from its top, said horizontal slide groove communicating with another end of said vertical slide groove so that said roller may be put in said horizontal groove from said vertical slide groove, at least one side of said first and said second convex wall is formed integral with a limiting rib plate having an insert hole for a pull cord to be inserted therethrough.

2. The blind fixing holder as claimed in claim 1, wherein said vertical slide groove and said horizontal slide groove are L-shaped.

3. The blind fixing holder as claimed in claim 1, wherein said vertical slide groove and said horizontal slide groove are T-shaped.

4. The blind fixing holder as claimed in claim 1, wherein said vertical slide groove has its lower end formed with a contracted neck for stopping the two ends of said roller from slipping off.

5. The blind fixing holder as claimed in claim 4, wherein said contracted neck of said vertical slide groove has its opposite walls respectively formed with a guiding slope slanting downward gradually.

* * * * *